US007114991B2

(12) United States Patent
Shiga et al.

(10) Patent No.: US 7,114,991 B2
(45) Date of Patent: Oct. 3, 2006

(54) WATERPROOF CONNECTOR SEALING MEMBER AND WATERPROOF CONNECTOR

(75) Inventors: Katsumi Shiga, Chiba (JP); Yoshihito Fujiwara, Tokyo (JP)

(73) Assignee: Tyco Electronics AMP K.K, Kanagawa-Ken (JP)

( * ) Notice: Subject to any disclaimer, the term of this patent is extended or adjusted under 35 U.S.C. 154(b) by 0 days.

(21) Appl. No.: 11/116,468

(22) Filed: Apr. 28, 2005

(65) Prior Publication Data

US 2005/0245130 A1 Nov. 3, 2005

(30) Foreign Application Priority Data

Apr. 28, 2004 (JP) ..... 2004-134570

(51) Int. Cl.
*H01R 13/40* (2006.01)

(52) U.S. Cl. ..... 439/587

(58) Field of Classification Search ..... 439/587, 439/589; 438/588

See application file for complete search history.

(56) References Cited

U.S. PATENT DOCUMENTS

| | | | | |
|---|---|---|---|---|
| 5,145,410 | A * | 9/1992 | Maejima et al. | 439/587 |
| 5,538,441 | A * | 7/1996 | Paolucci et al. | 439/589 |
| 5,839,920 | A * | 11/1998 | Yurko et al. | 439/587 |
| 6,176,739 | B1 | 1/2001 | Denlinger et al. | |
| 6,193,549 | B1 * | 2/2001 | Suzuki et al. | 439/589 |
| 6,341,983 | B1 * | 1/2002 | Crawford et al. | 439/587 |
| 6,371,807 | B1 * | 4/2002 | Takagishi et al. | 439/587 |
| 6,390,848 | B1 * | 5/2002 | Murakami et al. | 439/587 |
| 6,443,766 | B1 * | 9/2002 | Ichio et al. | 439/587 |
| 6,599,153 | B1 * | 7/2003 | Nishide | 439/681 |
| 6,739,908 | B1 * | 5/2004 | Hamai et al. | 439/587 |
| 6,872,092 | B1 * | 3/2005 | Oka | 439/587 |
| 6,913,486 | B1 * | 7/2005 | Nagayasu et al. | 439/587 |

FOREIGN PATENT DOCUMENTS

| | | |
|---|---|---|
| FR | 2792120 A | 10/2000 |
| JP | 1987 241277 | 10/1987 |
| JP | 1990 119372 | 9/1990 |

* cited by examiner

*Primary Examiner*—Tulsidas C. Patel
*Assistant Examiner*—Harshad Patel
(74) *Attorney, Agent, or Firm*—Barley Snyder LLC

(57) ABSTRACT

A waterproof connector sealing member has a plurality of electrical wire insertion holes that extend between the two main surfaces of a flat plate-shaped sealing main body. A plurality of projecting ribs are provided on the inner wall surface of each of the electrical wire insertion holes, and the projecting ribs of respectively adjacent electrical wire insertion holes are provided in different positions with respect to each other along the axial direction of the electrical wire insertion holes. Relief grooves are formed in the sealing main body in positions adjacent to the electrical wire insertion holes in the vicinity of the outer edges of this sealing main body, with each of these relief grooves extending from one of the main surfaces that is closer to the projecting rib of the adjacent electrical wire insertion hole provided toward the outside in the axial direction.

4 Claims, 10 Drawing Sheets

WATERPROOF CONNECTOR SEALING MEMBER AND WATERPROOF CONNECTOR

FIELD OF THE INVENTION

The present invention relates to a waterproof connector sealing member and a waterproof connector using the sealing member.

BACKGROUND

Waterproof connectors are conventionally used, for example, for electrical connections in automobiles. The waterproof connector sealing member shown in FIGS. 12A and 12B (see Japanese Utility Model Application Kokai No. H2-119372), for example, has been used for a waterproof connector.

In the waterproof connector sealing member 101, shown in FIG. 12B, a plurality of electrical wire insertion holes 103 extend between two main surfaces of a substantially circular flat, plate-shaped sealing main body 102. A plurality of ring-shaped sealing projections 104 are provided on the inner wall surface of each of the electrical wire insertion holes 103, and the sealing projections 104 of respectively adjacent electrical wire insertion holes 103 are formed in different positions with respect to each other along the axial direction of the electrical wire insertion holes 103.

The waterproof connector sealing member 101 is attached to a sealing member receiving cavity of a waterproof connector housing (not shown in the figures), and as a result of the outer circumferential surface of the sealing main body 102 contacting and pressing against the inner circumferential surface of the sealing member receiving cavity, a seal is formed between the outer circumferential surface of the sealing main body 102 and the inner circumferential surface of the sealing member receiving cavity.

Furthermore, a plurality of contacts (not shown in the figures) to which electrical wires (not shown in the figures) are connected are inserted into the electrical wire insertion holes 103 from the side of the contact insertion surface (right side in FIG. 12B) of the waterproof connector sealing member 101, with the side of the contacts inserted first, and when the insertion of these contacts is completed, the contacts are supported by being positioned inside contact receiving cavities (not shown in the figures) in the housing that is located on the inside (left side in FIG. 12B) of the waterproof connector sealing member 101. Moreover, the electrical wires that are connected to the contacts are positioned inside the electrical wire insertion holes 103 in the waterproof connector sealing member 101. Furthermore, the sealing projections 104 press the electrical wires from the peripheries of the electrical wires; as a result, the electrical wires are sealed, and the contacts inside the contact receiving cavities are waterproofed from the outside by the sealing projections 104.

In the insertion of these contacts into the electrical wire insertion holes 103, since the sealing projections 104 of respectively adjacent electrical wire insertion holes 103 are provided in different positions with respect to each other along the axial direction of the electrical wire insertion holes 103, the pressing force by means of the sealing projections 104 is not concentrated in specific locations along the axial direction between the respectively adjacent electrical wire insertion holes 103, so that the insertion of the contacts can be accomplished relatively easily.

Furthermore, the waterproof connector sealing member shown in FIGS. 13A and 13B (see Japanese Patent Application Kokai No. S62-241277) has also been used in the past in a waterproof connector.

As is shown in FIGS. 13A and 13B, in this waterproof connector sealing member 201, a plurality of electrical wire insertion holes 203 that extend between the two main surfaces of a substantially rectangular flat plate-shaped sealing main body 202 are formed in this sealing main body 202. A plurality of projecting ribs 204 are provided around the sealing main body 202, and receiving holes 205 are formed in the peripheries of the respective electrical wire insertion holes 203 on the side of the back surface of the sealing main body 202 as shown in FIG. 13B.

This waterproof connector sealing member 201 is attached to a sealing member receiving cavity 211 in a plug housing 210. In this case, a seal is created between the outer circumferential surface of the sealing main body 202 and the inner circumferential surface of the sealing member receiving cavity 211 by the outer circumferential surface of the sealing main body 202 contacting and pressing against the inner circumferential surface of the sealing member receiving cavity 211. In this case, positioning projections 213 provided on the plug housing 210 are inserted into the receiving holes 205 formed in the sealing member 201, so that the electrical wire insertion holes 203 in the sealing member 201 are positioned in locations corresponding to contact receiving cavities 212 in the plug housing 210.

Then, a plurality of contacts 220 to which electrical wires 230 are connected are inserted into the electrical wire insertion holes 203 from the side of the contact insertion surface (left side in FIG. 13A) of the waterproof connector sealing member 201, with the side of the contacts 220 inserted first, and when the insertion of these contacts is completed, the contacts 220 are supported by being positioned inside the contact receiving cavities 212 in the plug housing 210. Furthermore, the electrical wires 230 connected to the contacts 220 are positioned inside the electrical wire insertion holes 203 in the waterproof connector sealing member 201, so that the electrical wires 230 are sealed, and the contacts inside the contact receiving cavities 212 are waterproofed from the outside. Furthermore, the contacts 220 in the plug housing 210 mate with male type contacts 242 that protrude to the interior of a mating recessed part 241 of a mating connector 240, so that these parts are connected to each other.

However, the following problems have been encountered in these conventional waterproof connector sealing members shown in FIGS. 12A and 12B, and 13A and 13B:

Specifically, in the case of the waterproof connector sealing member 101 shown in FIGS. 12A and 12B, there is no relief area for the compressed sealing member around the electrical wire insertion holes 103 (especially on the outside of the electrical wire insertion holes 103) as shown in FIG. 12A. When the electrical wires are positioned inside the electrical wire insertion holes 103 by inserting the contacts into the electrical wire insertion holes 103, the sealing projections 104 and the sealing material around the sealing projections 104 are compressed by the electrical wires in the direction of expansion to the outside. However, since there is no relief area for the compressed sealing member around the electrical wire insertion holes 103 (especially on the outside of the electrical wire insertion holes 103), if a thick wire is inserted into a specified electrical wire insertion hole 103, for example, the sealing material escapes into the electrical wire insertion holes 103 adjacent to this electrical wire insertion hole 103, so that these electrical wire insertion holes 103 are longitudinally deformed to a great extent. In such a case, if thin electrical wires are inserted into these greatly deformed electrical wire insertion holes 103, there is a danger that a gap will be created between the electrical wires and the sealing projections 104, so that the desired sealing characteristics will not be obtained.

Furthermore, in the case of the waterproof connector sealing member 201 shown in FIGS. 13A and 13B, although the receiving holes 205 into which the positioning projections 213 of the plug housing 210 are inserted are formed around the electrical wire insertion holes 203, the receiving holes 205 are not formed around all of the electrical wire insertion holes 203 as shown in FIG. 13B. Regions where no receiving hole 205 is formed are present especially in the vicinity of the outer edges. Accordingly, there is a risk that the electrical wire insertion holes 203 in the vicinity of the regions where no receiving hole 205 is formed will be positionally shifted with respect to the contact receiving cavities 212. If a thick electrical wire is inserted into one of these positionally shifted electrical wire insertion holes 203, the sealing material escapes into the electrical wire insertion holes 203 that are adjacent to this electrical wire insertion hole 203, so that these electrical wire insertion holes 203 are longitudinally deformed to a great extent. In such a case, if thin electrical wires are inserted into these greatly deformed electrical wire insertion holes 203, there is a danger that a gap will be created between the electrical wires and the sealing projections inside the electrical wire insertion holes, so that the desired sealing characteristics will not be obtained.

SUMMARY

The present invention was devised in light of the problems described above; it is an object of the present invention to provide a waterproof connector sealing member and a waterproof connector which can effectively seal electrical wires having a wide range of diameters.

In order to solve the problems described above, a waterproof connector sealing member is provided in which: a plurality of electrical wire insertion holes extend between the two main surfaces of a flat plate-shaped sealing main body, a plurality of projecting ribs are provided on the inner wall surface of each of the electrical wire insertion holes, the projecting ribs of respectively adjacent electrical wire insertion holes are provided in different positions with respect to each other along the axial direction of the electrical wire insertion holes, relief grooves are formed in the sealing main body in position between the electrical wire insertion holes in the vicinity of the outer edges of the sealing main body, with each relief groove extending from one of the main surfaces that is closer to the projecting rib of the adjacent electrical wire insertion hole provided toward the outside in the axial direction.

A waterproof connector having the sealing member described above, is also provided.

DETAILED DESCRIPTION OF THE EMBODIMENTS

Figure 1:
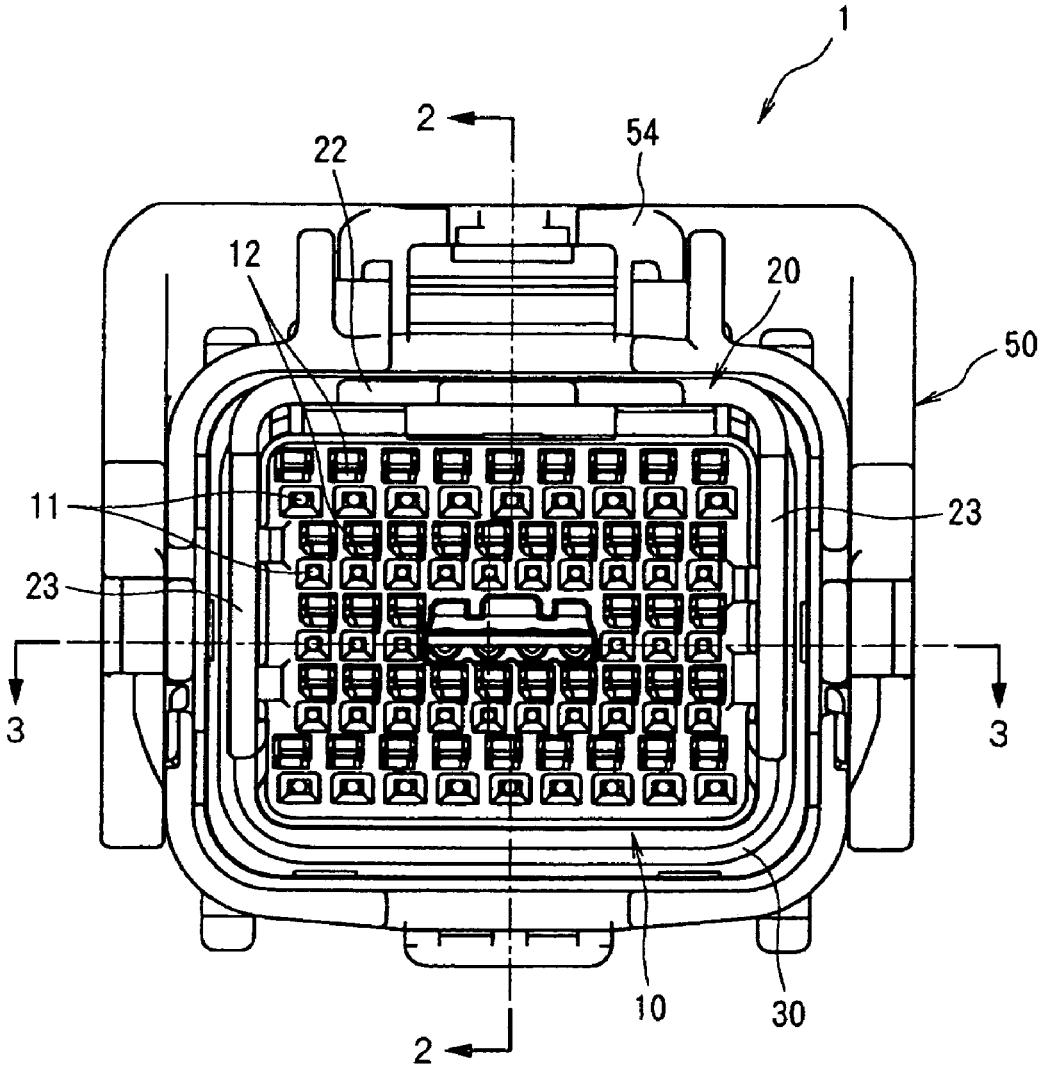
FIG. 1 is a front view of a waterproof connector according to an exemplary embodiment of the present invention, with the retainer being in a temporary locking position.

Next, an embodiment of the present invention will be described with reference to the figures.

In FIGS. 1 through 6, the waterproof connector 1 comprises a first housing (housing) 10 that accommodates contacts (not shown in the figures), a retainer 20, a mating part sealing member 30, an electrical wire sealing member (sealing member) 40, and a second housing 50.

Here, the first housing 10 is formed with a substantially rectangular shape by molding an insulating resin, and has a plurality of rows of contact accommodating cavities 11 that accommodate the contacts. The individual contact accommodating cavities 11 are provided with housing lances 12 that perform primary locking of the contacts inserted into the respective contact accommodating cavities 11.

Figure 7:
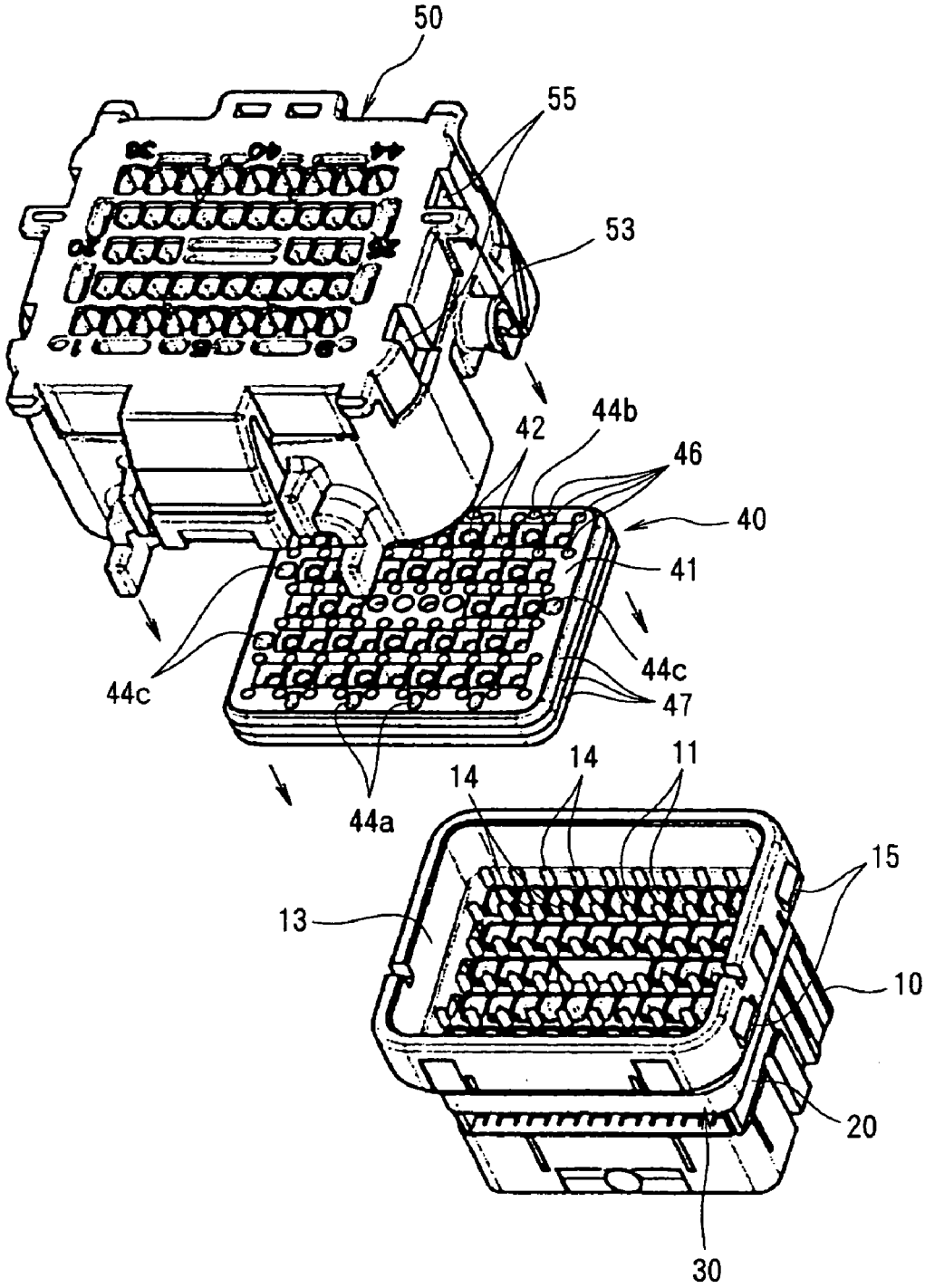
FIG. 7 is an exploded perspective view of the connector of FIGS. 1 and 4, in which the first housing, electrical wire sealing member, and second housing are seen from the side of the contact insertion surfaces.
Figure 9A:
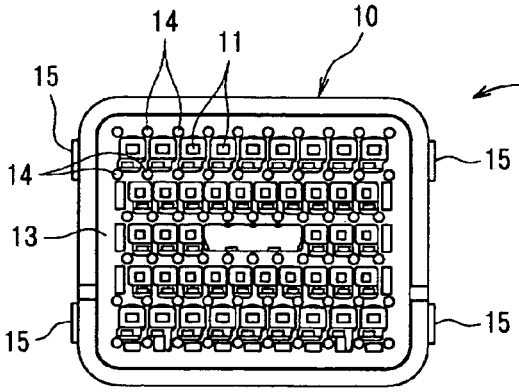
FIGS. 9A and 9B are diagrams of the connector of FIGS. 2 and 4, showing the first housing of a connector according to an exemplary embodiment of the present invention, as seen from the side of the contact insertion surface, and the electrical wire sealing member as seen from the side of the mating connector reception surface, respectively.
Figure 9B:
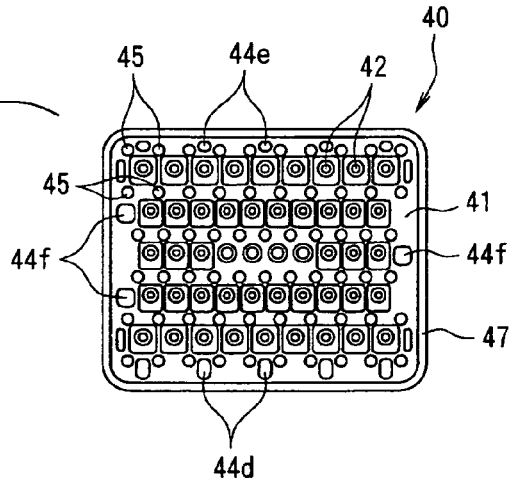

Furthermore, as is shown clearly in FIGS. 2, 3, 5, 6, 7 and 9, a sealing member accommodating recess 13 is formed on the side of the contact insertion surface (right side in FIG. 2) of the first housing 10. Moreover, positioning projections 14 are formed in this sealing member accommodating recess 13 by protruding from all four corners of each of the contact accommodating cavities 11 as shown in FIGS. 7 and 9.

Figure 2:
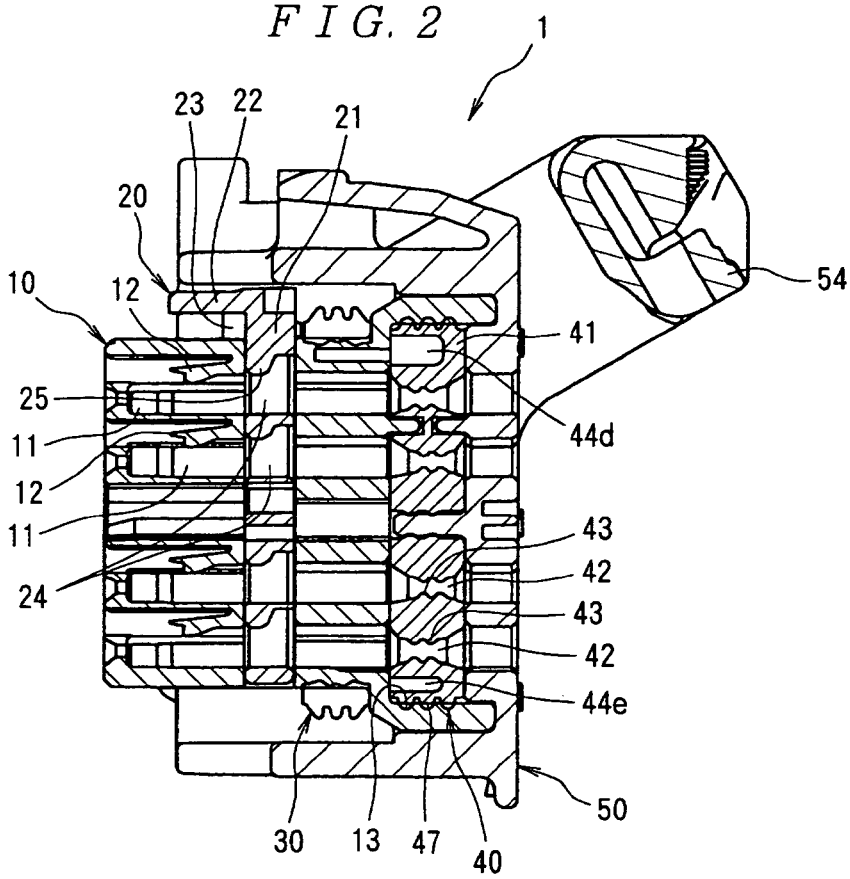
FIG. 2 is a sectional view of the connector of FIG. 1, taken along line 2—2 in FIG. 1.
Figure 3:
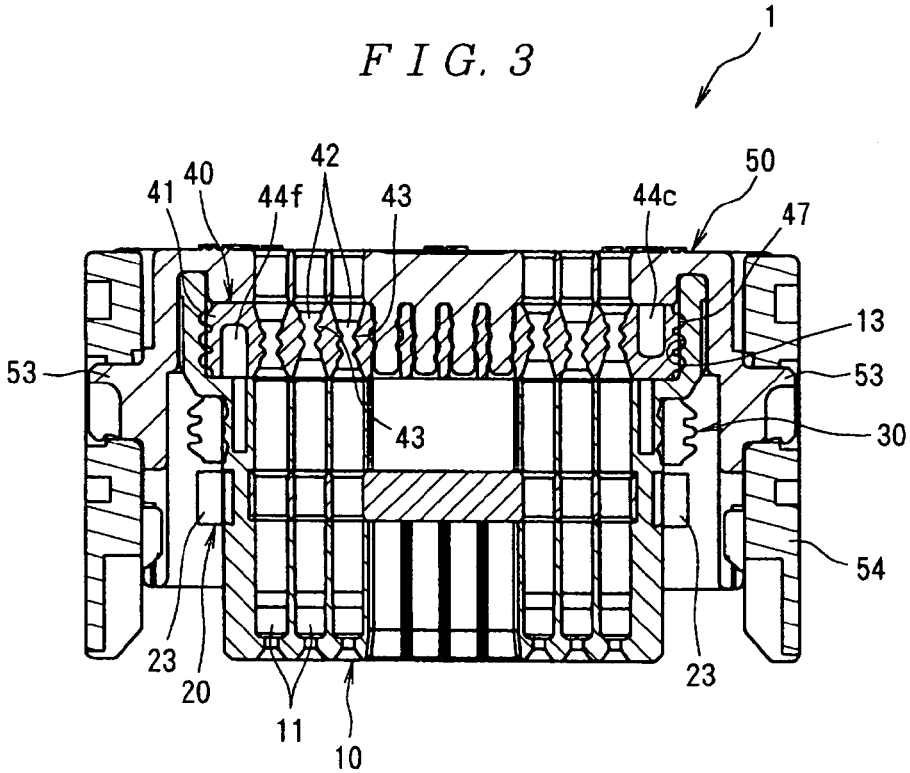
FIG. 3 is a sectional view of the connector of FIG. 1, taken along line 3—3 in FIG. 1.
Figure 4:
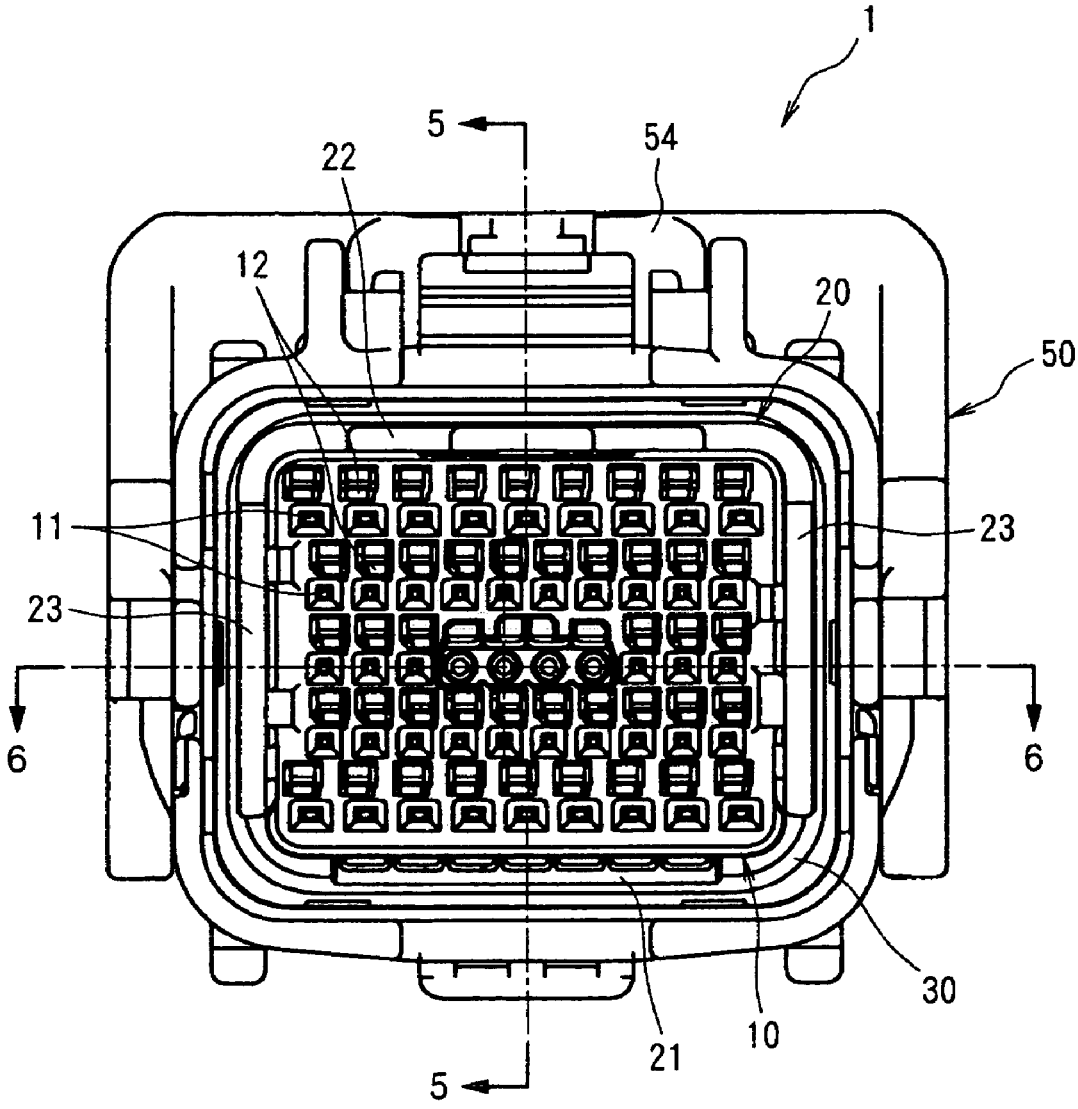
FIG. 4 is a front view of a waterproof connector of FIG. 1, with the retainer being in a main locking position.
Figure 5:
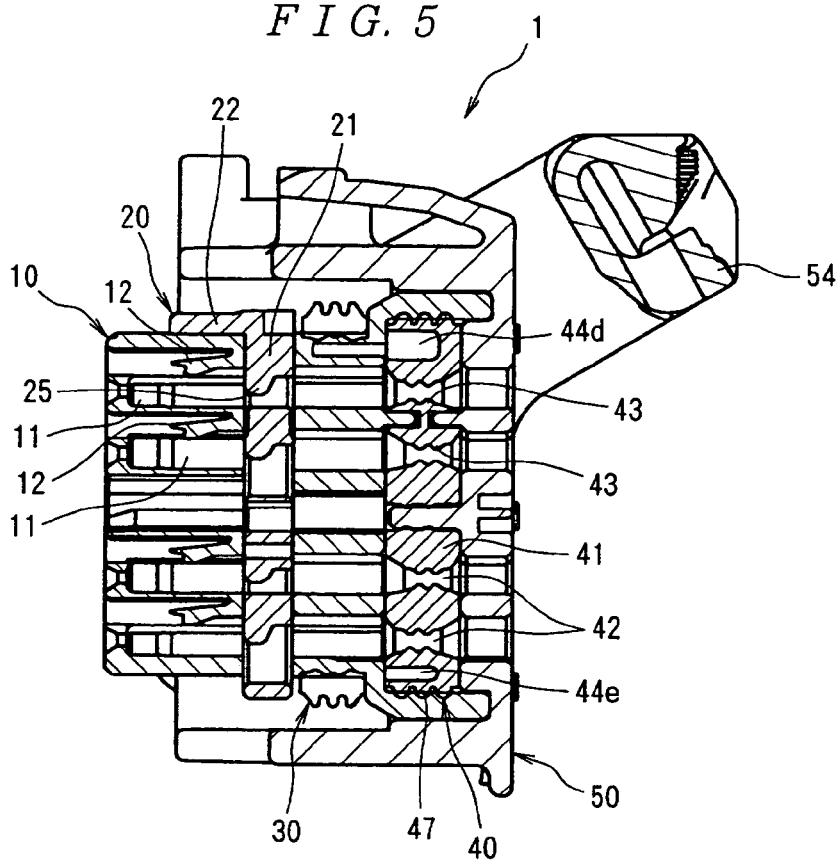
FIG. 5 is a sectional view of the connector of FIGS. 1 and 4, taken along line 5—5 in FIG. 4.
Figure 6:
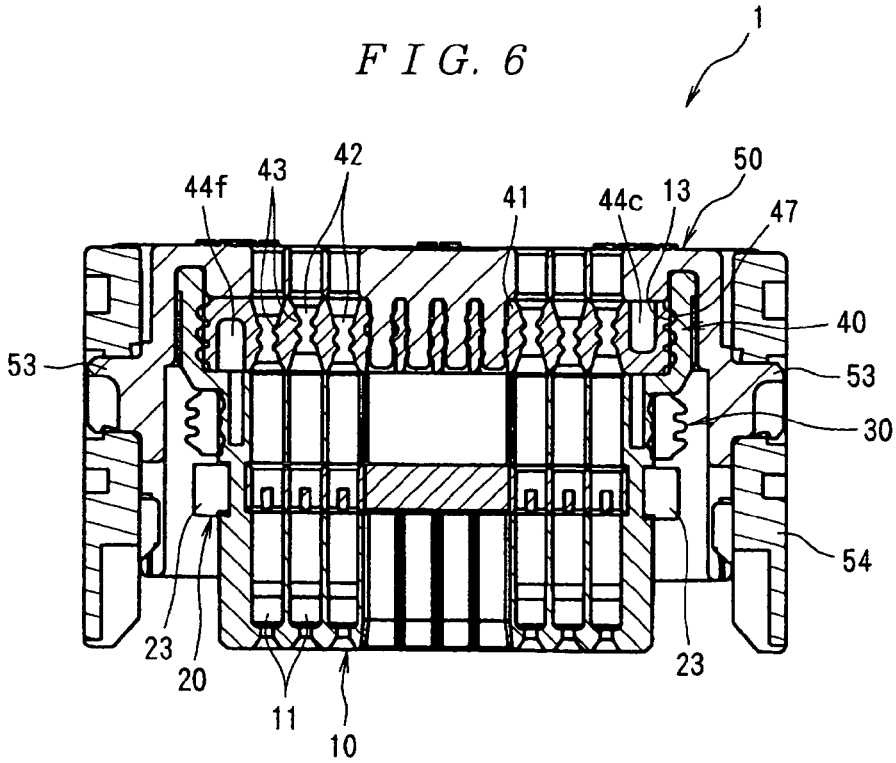
FIG. 6 is a sectional view of the connector of FIGS. 1 and 4, taken along line 6—6 in FIG. 4.

The retainer 20 is used to perform secondary locking of the contacts that are accommodated inside the respective contact accommodating cavities 11, and comprises a rectangular base plate part 21, an upper plate part 22 that extends forward (to the left in FIG. 2) from the upper end of the base plate part 21, and a pair of side plate parts 23 that extend downward from either end of the upper plate part 22 in the direction of width. The retainer 20 is formed by molding an insulating resin. Furthermore, the retainer 20 is attached to the first housing 10 substantially in the central portion of this first housing 10 in the forward-rearward direction by the upper plate part 22 being positioned above the first housing 10 and the side plate parts 23 being positioned on the outside of the side portions of the first housing so that the retainer can move upward and downward between the temporary locking position shown in FIGS. 1 through 3 and the main locking position shown in FIGS. 4 through 6. A plurality of rows of openings 24 for the insertion of the contacts that are to be accommodated into the respective contact accommodating cavities 11 are formed in the base plate part 21 of the retainer 20 in positions corresponding to the respective contact accommodating cavities 11. Furthermore, a secondary locking part 25 for performing the secondary locking of the corresponding contact is provided on the upper side of each opening 24. In the temporary locking position, as is shown in FIGS. 1 and 2, the retainer 20 is positioned above the upper surface of the first housing 10, with the upper plate part 22 having a specified gap, so that the contacts can be accommodated into the contact accommodating cavities 11 by passing through the openings 24. Moreover, in the main locking position, as is shown in FIGS. 4 and 5, the retainer 20 is devised so that the upper plate part 22 contacts the upper surface of the first housing 10, and so that the secondary locking of the contacts that are accommodated inside the contact accommodating cavities 11 is accomplished by the secondary locking parts 25.

The mating part sealing member 30 is used to form a seal between the mating part of a mating connector (not shown in the figures) and the first housing 10; this mating part sealing member 30 is formed with a substantially square ring shape, and is attached to the periphery of the first housing 10 toward the rear of the retainer 20. When the retainer 20 is in the temporary locking position, the mating part sealing member 30 is supported by the base plate part 21 and both side plate parts 23 of the retainer 20 at three points (i.e., portion located above the first housing 10 and portions located on the outside of the two side portions of the first housing 10). Furthermore, when the retainer 20 is in the main locking position, the mating part sealing member 30 is supported by the base plate part 21 and both side plate parts 23 of the retainer 20 at four points (i.e., portion located above the first housing 10, portions located on the outside of the two side portions of the first housing 10, and portion located beneath the first housing 10).

As is shown in FIGS. 2, 3, 5 and 6, the electrical wire sealing member 40 is disposed inside a sealing member accommodating recess 13 of the first housing 10. The electrical wire sealing member 40 is constructed from a rubber material, and as is clearly shown in FIGS. 11A through 11F, a plurality of electrical wire insertion holes 42 extend between the two main surfaces of a substantially rectangular flat plate-shaped sealing main body 41. The positions in which the electrical wire insertion holes 42 are formed correspond to the positions of the contact accommodating cavities 11. A plurality of projecting ribs 43 are provided on the inner wall surface of each of the electrical wire insertion holes 42. Furthermore, as is shown clearly in FIGS. 11B and 11E, the projecting ribs 43 of respectively adjacent electrical wire insertion holes 42 are provided in different positions with respect to each other along the axial direction of the electrical wire insertion holes 42. The size of the radius of the at the tip ends of the projecting ribs 43 is preferably 0.3 mm or less, and the gap between the two adjacent projecting ribs 43 in the axial direction is preferably 1.3 mm or less. By reducing the size of the radius formed at the tip ends of the projecting ribs 43 and by reducing the gap between the two adjacent projecting ribs 43 in the axial direction, it is possible to lower the surface pressure of the electrical wire sealing member 40 with respect to the electrical wires (not shown in the figures), to reduce the insertion force of the contacts, and to prevent the tearing of the rubber material of the electrical wire sealing member 40 caused by the expansion of the electrical wire insertion holes 42 by the contacts during the insertion of the contacts.

Figure 11F:
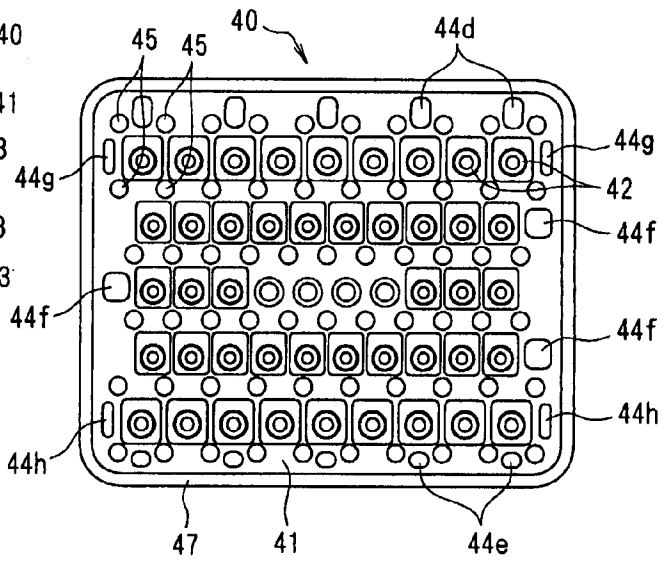
FIG. 11 shows an electrical wire sealing member according to an exemplary embodiment of the present invention, with FIG. 11A being a plan view of the electrical wire sealing member as seen from the side of the contact insertion surface, FIG. 11B being a sectional view along line 11B—11B in FIG. 11A, FIG. 11C being a sectional view along line 11C—11C in FIG. 11(A), FIG. 11(D) being a sectional view along line 11D—11D in FIG. 11A, FIG. 11E being a sectional view along line 11E—11E in FIG. 11A, and FIG. 11F being a plan view of the electrical wire sealing member as seen from the side of the mating connector reception surface.
Figure 11E:
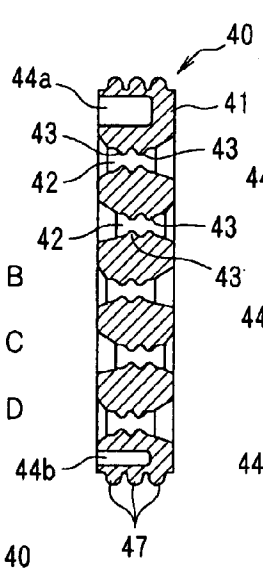
Figure 11A:
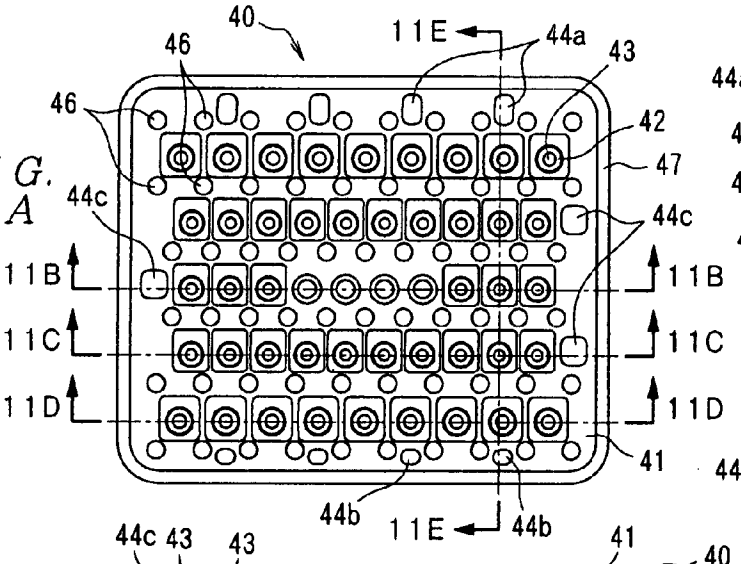
Figure 11B:
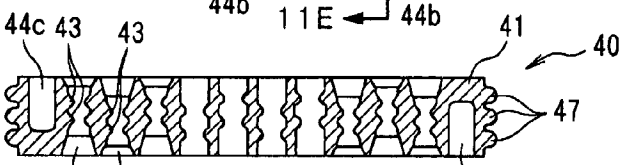
Figure 11C:
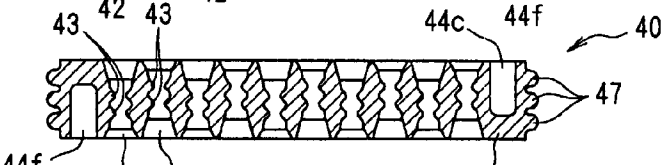
Figure 11D:
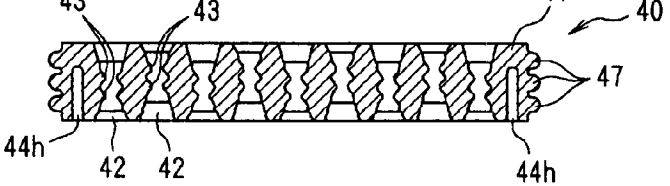
Figure 12A:
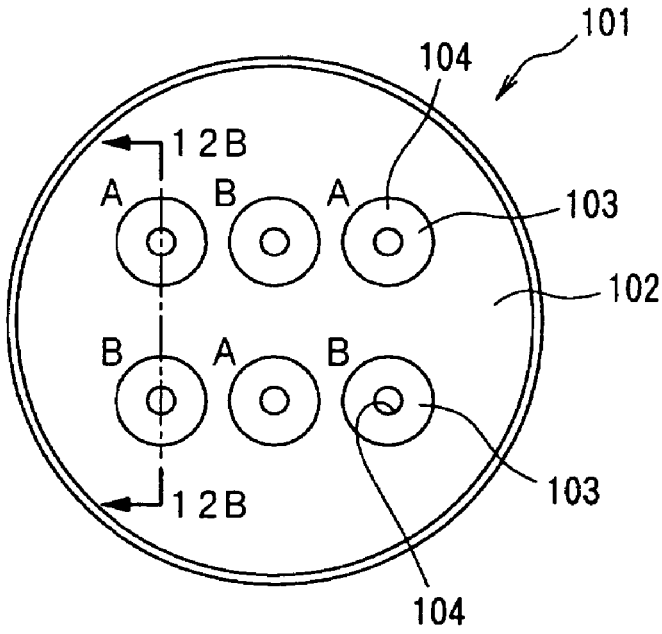
FIGS. 12A and 12B show conventional examples of a waterproof connector sealing member, with FIG. 12A being a plan view, and FIG. 12B being a sectional view along line 12B—12B in FIG. 12A.
Figure 12B:
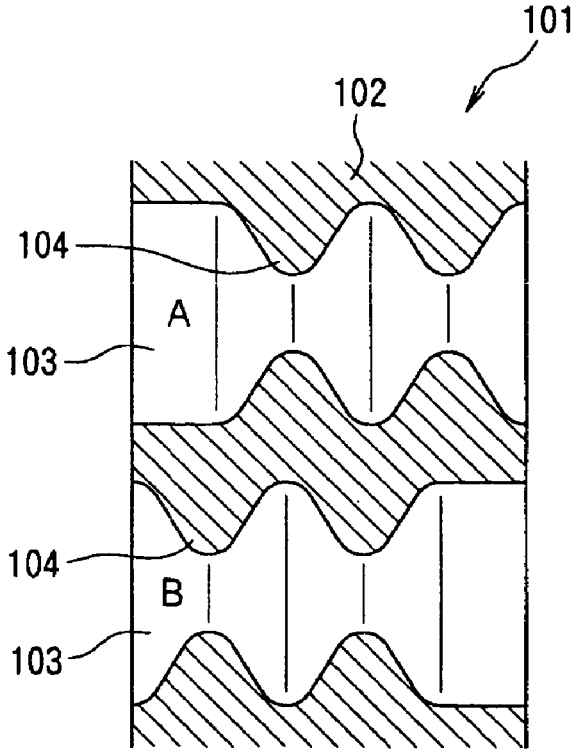
Figure 13A:
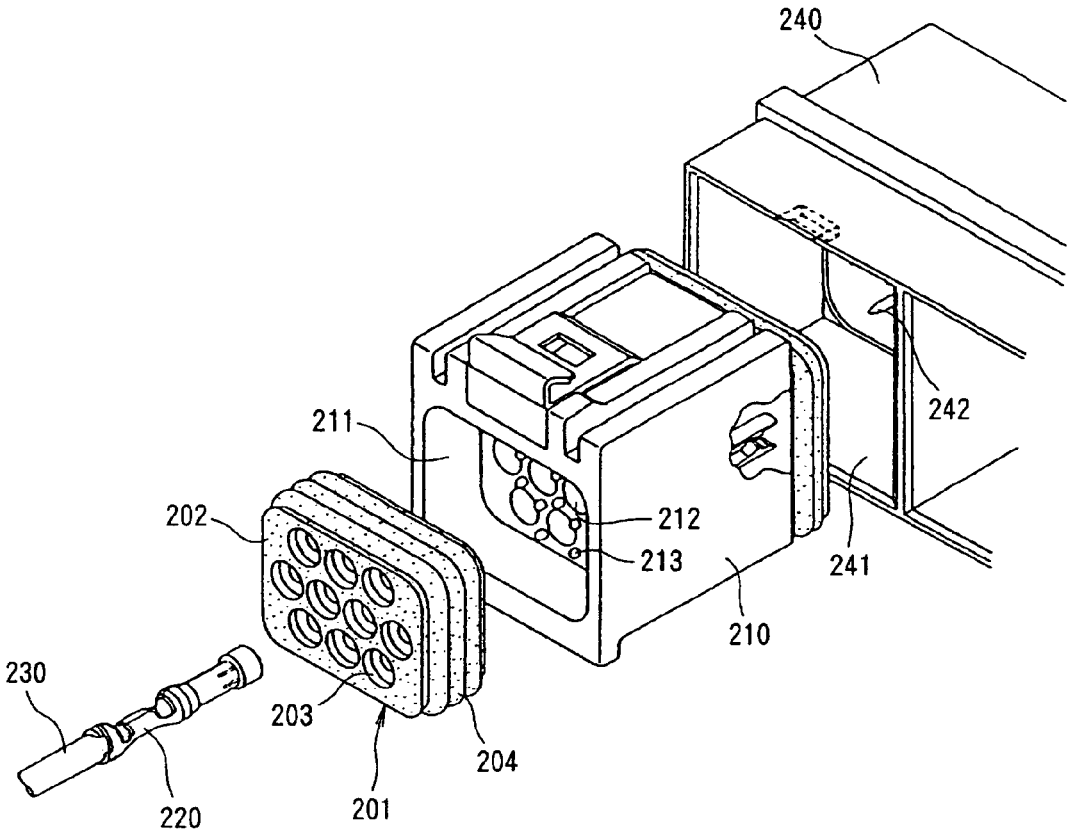
FIGS. 13A and 13B show another conventional examples of a waterproof connector sealing member, with FIG. 13A being an exploded perspective view of a waterproof connector using a waterproof connector sealing member, and FIG. 12B being a perspective view of the waterproof connector sealing member.
Figure 13B:
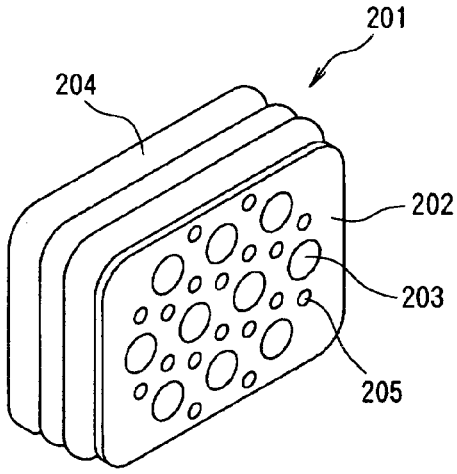

Furthermore, as is shown in FIGS. 11A through 11F, relief grooves 44*a*, 44*b*, 44*c*, 44*d*, 44*e*, 44*f*, 44*g* and 44*h* are formed in the electrical wire sealing member 40 in positions adjacent to the electrical wire insertion holes 42 in the vicinity of the outer edges of the sealing main body 41, with each of these relief grooves extending from one of the main surfaces of the sealing main body 41 on the side closer to the projecting rib 43 (of the adjacent electrical wire insertion hole 42) that is provided toward the outside in the axial direction. In the illustrated exemplary embodiment, as is shown in FIG. 11A, with regard to the side of the contact insertion surface of the electrical wire sealing member 40, the relief grooves 44*a* are formed from the side of the contact insertion surface of the sealing main body 41 above the second, fourth, sixth and eighth electrical wire insertion holes 42 from the right side of the first row from the top, and the relief grooves 44*c* are formed from the side of the contact insertion surface of the sealing main body 41 on the right side of the rightmost electrical wire insertion hole 42 of the second row from the top, on the left side of the leftmost electrical wire insertion hole 42 of the third row from the top, and on the right side of the rightmost electrical wire insertion hole 42 of the fourth row from the top. Moreover, the relief grooves 44*b* are formed from the side of the contact insertion surface of the sealing main body 41 beneath the second, fourth, sixth and eighth electrical wire insertion holes 42 from the right side of the fifth row from the top. In addition, as is shown in FIG. 11F, with regard to the side of the mating connector reception surface of the electrical wire sealing member 40, the relief grooves 44*d* are formed from the side of the mating connector reception surface (left side in FIG. 2) of the sealing main body 41 above the first, third, fifth, seventh and ninth electrical wire insertion holes 42 from the right side of the first row from the top, and the relief grooves 44*g* are formed from the side of the mating connector reception surface of the sealing main body 41 on the right side of the rightmost electrical wire insertion hole 42 of the first row from the top and on the left side of the leftmost electrical wire insertion hole 42 of the first row from the top. Furthermore, the relief grooves 44*f* are formed from the side of the mating connector reception surface of the sealing main body 41 on the right side of the rightmost electrical wire insertion hole 42 of the second row from the top, on the left side of the leftmost electrical wire insertion hole 42 of the third row from the top, and on the right side of the rightmost electrical wire insertion hole 42 of the fourth row from the top, the relief grooves 44*h* are formed from the side of the mating connector reception surface of the sealing main body 41 on the right side of the rightmost electrical wire insertion hole 42 of the fifth row from the top and on the left side of the leftmost electrical wire insertion hole 42 of the fifth row from the top, and the relief grooves 44*e* are formed from the side of the mating connector reception surface of the sealing main body 41 beneath the first, third, fifth, seventh and ninth electrical wire insertion holes 42 from the right side of the fifth row from the top.

Figure 8:
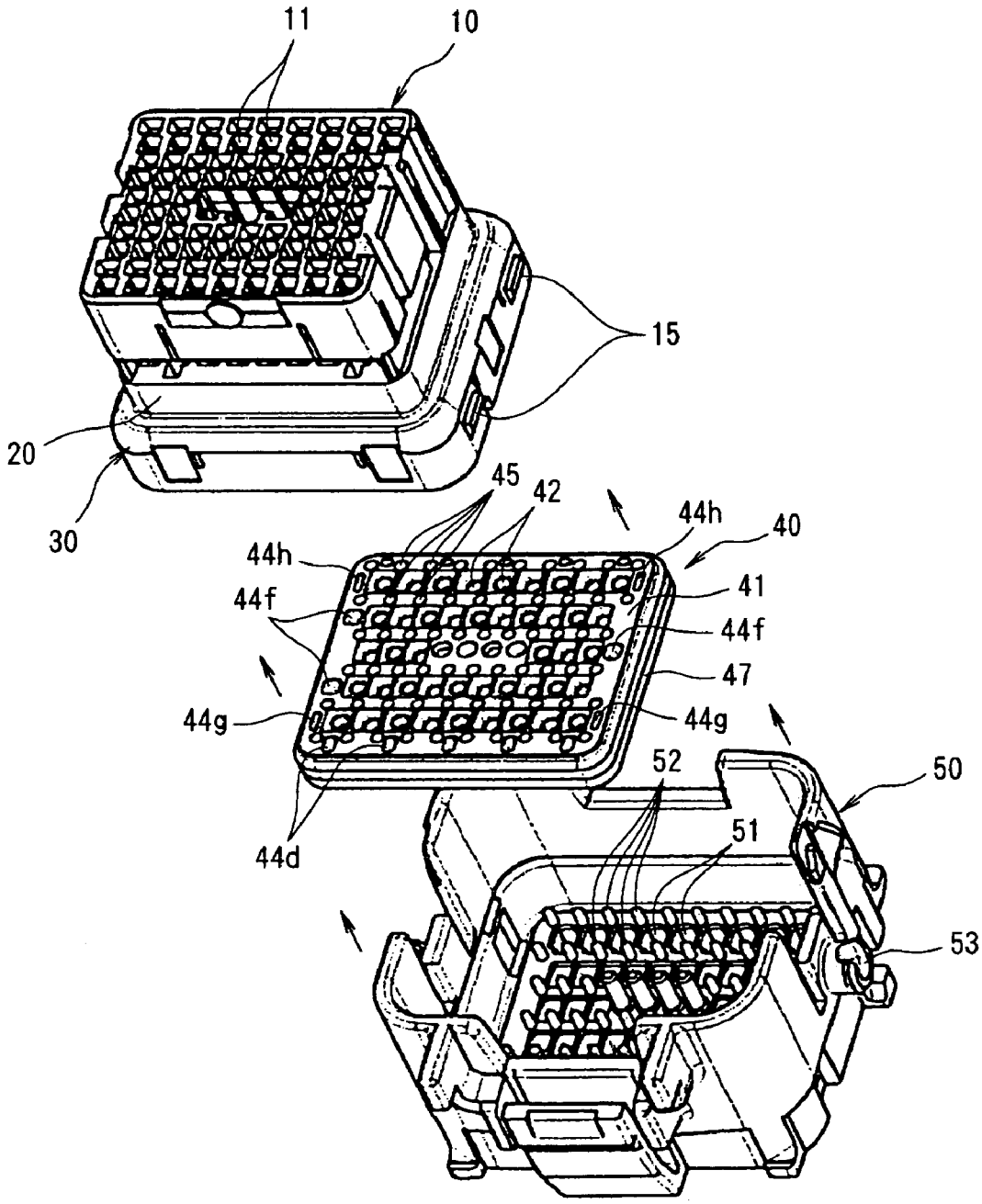
FIG. 8 is an exploded perspective view of the connector of FIGS. 1 and 4, in which the first housing, electrical wire sealing member, and second housing are seen from the side of the mating connector reception surfaces.
Figure 10A:
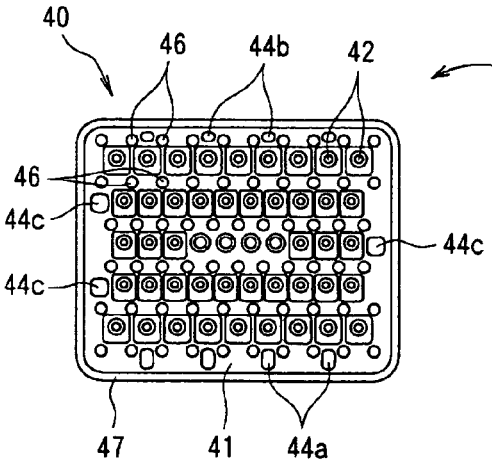
FIGS. 10A and 10B are diagrams of the connector of FIGS. 1 and 4, showing the electrical wire sealing member as seen from the side of the contact insertion surface, and the second housing as seen from the side of the mating connector reception surface, respectively.
Figure 10B:
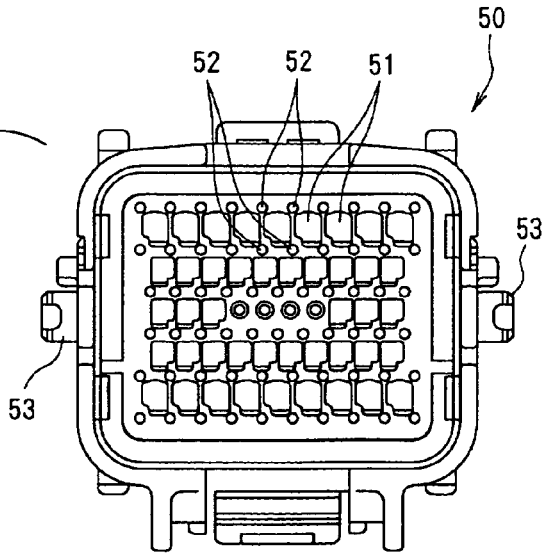

Furthermore, as is shown in FIGS. 8, 9 and 11F, on the side of the mating connector reception surface of the sealing main body 41 of the electrical wire sealing member 40, sealing member positioning holes 45 into which the positioning projections 14 are inserted are formed in all four corners of the respective electrical wire insertion holes 42. Meanwhile, as is shown in FIGS. 7, 10 and 11A, on the side of the contact insertion surface of the electrical wire sealing member 40, separate sealing member positioning holes 46 are formed in all four corners of the respective electrical wire insertion holes 42. These sealing member positioning holes 46 are designed for the insertion of positioning projections 52 that are provided on the second housing 50. Moreover, a plurality of projecting ribs 47 are formed on the outer circumferential surface of the sealing main body 41 of the electrical wire sealing member 40. When the electrical wire sealing member 40 is disposed inside the sealing member accommodating recess 13 in the first housing 10, as a result of these projecting ribs 47 contacting and pressing against the inner circumferential surface of the sealing member accommodating recess 13, a seal is created between the outer circumferential surface of the sealing main body 41 and the inner circumferential surface of the sealing member accommodating recess 13.

The second housing 50 holds the electrical wire sealing member 40 that is disposed inside the sealing member accommodating recess 13 of the first housing 10 from the side of the contact insertion surface, and is formed with a cap shape that covers the first housing 10, retainer 20, mating part sealing member 30, and electrical wire sealing member 40. Contact insertion holes 51 (best shown in FIG. 8) are formed in the second housing 50 in positions corresponding to the contact accommodating cavities 11 in the first housing 10 and the electrical wire insertion holes 42 in the electrical wire sealing member 40. Positioning projections 52 that are inserted into the sealing member positioning holes 46 in the electrical wire sealing member 40 are formed protruding from all four corners of the respective contact insertion holes 51. Moreover, supporting shafts 53 are provided on both side portions of the second housing 50 in the direction of width, and a cam lever member 54 is supported in a pivotable manner on these supporting shafts 53.

As is shown in FIG. 7, a plurality of locking projections 15 are formed on both side portions of the first housing 10 in the direction of width, while locking holes 55 with which the locking projections 15 are engaged are formed in both side portions of the second housing 50 in the direction of width.

Next, a method for assembling the waterproof connector 1 will be described.

First, the mating part sealing member 30 is attached to the first housing 10, and the retainer 20 is positioned in the temporary locking position with respect to the first housing 10.

Then, as is shown in FIGS. 7, 8 and 9, the electrical wire sealing member 40 is disposed in the sealing member accommodating recess 13 of the first housing 10, with the side of the mating connector reception surface of the electrical wire sealing member 40 facing the first housing 10. In this case, the positioning projections 14 provided on the first housing 10 are inserted into the sealing member positioning holes 45 in the electrical wire sealing member 40, so that the electrical wire insertion holes 42 formed in the electrical wire sealing member 40 are positioned in alignment with the contact accommodating cavities 11 formed in the first housing 10. At the same time, furthermore, the projecting ribs 47 of the electrical wire sealing member 40 contact and press against the inner circumferential surface of the sealing member accommodating recess 13, thus creating a seal between the outer circumferential surface of the sealing main body 41 and the inner circumferential surface of the sealing member accommodating recess 13.

Next, as is shown in FIGS. 7, 8 and 10, the second housing 50 is attached to the first housing 10, with the side of the mating connector reception surface of the second housing 50 facing the first housing 10. In this case, the locking projections 15 of the first housing 10 are engaged with the locking holes 55 in the second housing 50. As a result, the electrical wire sealing member 40 is prevented from slipping out by the second housing 50 inside the sealing member accommodating recess 13 as shown in FIG. 2. In this case, the positioning projections 52 of the second housing 50 are inserted into the sealing member positioning holes 46 in the electrical wire sealing member 40, so that the electrical wire insertion holes 42 formed in the electrical wire sealing member 40 are positioned in alignment with the contact insertion holes 51 formed in the second housing 50.

Then, a plurality of contacts to which the electrical wires are connected are inserted, with the side of the contacts first, from the side of the contact insertion surface of the second housing 50 via the contact insertion holes 51 and the electrical wire insertion holes 42 of the electrical wire sealing member 40 into the contact accommodating cavities 11 of the first housing 10. Since the retainer 20 is in the temporary locking position, the insertion of the contacts can be pushed forward via the openings 24 in the retainer 20, and the primary locking of the contacts can be performed by the housing lances 12.

Subsequently, the retainer 20 is moved from the temporary locking position to the main locking position. Then, the secondary locking of the contacts that are accommodated inside the contact accommodating cavities 11 is performed by the secondary locking parts 25. As a result, the assembly of the waterproof connector 1 is completed.

In a state in which the waterproof connector 1 is assembled, the plurality of electrical wires connected to the contacts are positioned inside the electrical wire insertion holes 42 of the electrical wire sealing member 40, and the projecting ribs 43 provided on the electrical wire insertion holes 42 press the electrical wires from the peripheries of the electrical wires, thus sealing the electrical wires. As a result, the contacts inside the contact accommodating cavities 11 can be waterproofed from the outside.

Furthermore, in the insertion of the contacts into the electrical wire insertion holes 42, since the projecting ribs 43 of respectively adjacent electrical wire insertion holes 42 are provided in different positions with respect to each other along the axial direction of the electrical wire insertion holes 42, the pressing force by means of the projecting ribs 43 is not concentrated in specific locations along the axial direction between respectively adjacent electrical wire insertion holes 42, so that the insertion of the contacts can be accomplished relatively easily.

Moreover, in the present embodiment, the relief grooves 44*a*, 44*b*, 44*c*, 44*d*, 44*e*, 44*f*, 44*g* and 44*h* are formed in the electrical wire sealing member 40 in positions adjacent to the electrical wire insertion holes 42 in the vicinity of the outer edges of the sealing main body 41, with each of these relief grooves extending from one of the main surfaces of the sealing main body 41 on the side closer to the projecting rib 43 (of the adjacent electrical wire insertion hole 42) that is provided toward the outside in the axial direction. Accordingly, when the plurality of electrical wires are respectively positioned inside the electrical wire insertion holes 42, the portions of the sealing material that are provided with the projecting ribs 43 and compressed by the electrical wires in the direction of expansion to the outside can be caused to escape into the relief grooves 44*a*, 44*b*, 44*c*, 44*d*, 44*e*, 44*f*, 44*g* and 44*h*. Consequently, electrical wires with a wide range of diameters can be effectively sealed.

Furthermore, the sealing member positioning holes 45 are formed in all four corners of the respective electrical wire insertion holes 42 on the side of the mating connector reception surface of the sealing main body 41 of the electrical wire sealing member 40, and the positioning projections 14 that are inserted into the sealing member positioning holes 45 are provided inside the sealing member accommodating recess 13 in the first housing 10. Accordingly, the positioning of the respective electrical wire insertion holes 42 with respect to the first housing 10 and contact accommodating cavities 11 can be reliably accomplished, so that it is possible to effectively prevent the deformation of the respective electrical wire insertion holes 42 and to seal the electrical wires of a wide range of diameters even more effectively.

In addition, the sealing member positioning holes 46 are formed in all four corners of the respective electrical wire insertion holes 42 on the side of the contact insertion surface of the sealing main body 41 of the electrical wire sealing member 40, and the positioning projections 52 that are inserted into the sealing member positioning holes 46 are provided in the second housing 50. Accordingly, the positioning of the respective electrical wire insertion holes 42 with respect to the second housing 50 and contact insertion holes 51 can be reliably accomplished, so that it is possible to effectively prevent the deformation of the respective electrical wire insertion holes 42 and to seal the electrical wires of a wide range of diameters even more effectively.

An embodiment of the present invention was described above. However, the present invention is not limited to this embodiment, and various alterations or modifications can be made.

For example, the sealing main body 41 of the electrical wire sealing member 40 is formed with a substantially rectangular flat plate shape. However, as long as this sealing main body is formed in a flat plate shape, any external profile may be used; for instance, a circular flat plate shape may be used.

Furthermore, as long as the electrical wire sealing member 40 can be disposed on the side of the contact insertion surface of the first housing 10, the second housing 50 is not absolutely necessary.

Moreover, it is not absolutely necessary to form the sealing member positioning holes 46 on the side of the contact insertion surface of the sealing main body 41 of the electrical wire sealing member 40.

What is claimed is:

1. A waterproof connector sealing member in which:

a plurality of electrical wire insertion holes extend between the two main surfaces of a flat plate-shaped sealing main body, a plurality of projecting ribs are provided on the inner wall surface of each of the electrical wire insertion holes, and the projecting ribs of each electrical wire insertion hole are located in different positions with respect to the projecting ribs of its adjacent electrical wire insertion hole along the axial direction of the electrical wire insertion holes, relief grooves are formed in the sealing main body in positions between the electrical wire insertion holes in the vicinity of the outer edges of the sealing main body and the outer edges, the outer edges having projecting ribs formed thereon, with each relief groove extending from one of the main surfaces that is closer to the projecting rib of an adjacent electrical wire insertion hole provided toward the outside in the axial direction.

2. The waterproof connector sealing member according to claim 1, wherein sealing member positioning holes are formed in all four corners of the respective electrical wire insertion holes.

3. A waterproof connector comprising:

a housing that accommodates contacts; and a sealing member that is disposed on the side of the contact insertion surface of the housing, the sealing member having a flat plate-shaped sealing main body with a plurality of electrical wire insertion holes that extend between the two main surfaces of the sealing main body, a plurality of projecting ribs provided on the inner wall surface of each of the electrical wire insertion holes, and the projecting ribs of each electrical wire insertion hole, the being provided in different positions with respect to the projecting ribs of its adjacent electrical wire insertion hole along the axial direction of the electrical wire insertion holes, wherein relief grooves are formed in the sealing main body in positions between the electrical wire insertion holes in the vicinity of the outer edges of the sealing main body and the outer edges, the outer edges having projecting ribs formed thereon, with each relief groove extending from one of the main surfaces that is closer to the projecting rib of the adjacent electrical wire insertion hole provided toward the outside in the axial direction.

4. A waterproof connector according to claim 3, wherein sealing member positioning holes are formed in all four corners of the respective electrical wire insertion holes in the sealing member, and positioning projections that are inserted into these sealing member positioning holes are provided on the contact insertion surface of the housing.

* * * * *

UNITED STATES PATENT AND TRADEMARK OFFICE

CERTIFICATE OF CORRECTION

PATENT NO. : 7,114,991 B2
APPLICATION NO. : 11/116468
DATED : October 3, 2006
INVENTOR(S) : Katsumi Shiga et al.

It is certified that error appears in the above-identified patent and that said Letters Patent is hereby corrected as shown below:

In column 10, line 41, “insertion hole, the being” should read -- insertion hole, being --.

Signed and Sealed this

Fifth Day of December, 2006

JON W. DUDAS
*Director of the United States Patent and Trademark Office*